United States Patent [19]

Clark

[11] Patent Number: 5,074,795

[45] Date of Patent: Dec. 24, 1991

[54] METHOD FOR TEACHING CHILDREN TO SKI

[75] Inventor: David B. Clark, Steamboat Springs, Colo.

[73] Assignee: Wee Ski, Inc., Steamboat Springs, Colo.

[21] Appl. No.: 664,293

[22] Filed: Mar. 4, 1991

Related U.S. Application Data

[63] Continuation of Ser. No. 591,247, Sep. 27, 1990, abandoned, which is a continuation of Ser. No. 435,755, Nov. 14, 1989, abandoned.

[51] Int. Cl.[5] ..... A63B 69/18

[52] U.S. Cl. ..... 434/253; 119/96; 280/801

[58] Field of Search ..... 434/253, 254; 272/70, 272/70 A, 71, 119, 97; 119/29, 96; 273/DIG. 18, DIG. 19; 280/801

[56] References Cited

U.S. PATENT DOCUMENTS 3,014,284 12/1961 Hall .
3,487,474 1/1970 De Meo .
4,308,629 1/1982 Freemon .
4,424,040 1/1984 Buchheister et al. .
4,445,866 5/1984 Cillieres .
4,505,681 3/1985 Jones .
4,509,921 4/1985 Buchheister .
4,577,859 3/1986 Gossett .
4,666,017 5/1987 Zimmerman .
4,667,624 5/1987 Smith .
4,756,555 7/1988 Bachmann .

*Primary Examiner*—Robert Bahr
*Assistant Examiner*—J. Doyle
*Attorney, Agent, or Firm*—G. Turner Moller

[57] ABSTRACT

A method for teaching children to ski uses a wide torso encircling band and two pairs of reins of different length. At an early stage of learning, the instructor straddles the child and uses short reins to directly control the speed and direction of the child and the pair of ski slowly. At a later stage of learning, the instructor backs away from the child and uses the long reins to directly control the child's speed and indirectly control the child's direction.

6 Claims, 1 Drawing Sheet

FIG. 1
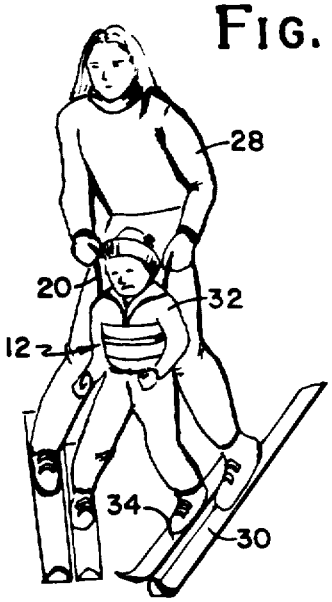
FIG. 2
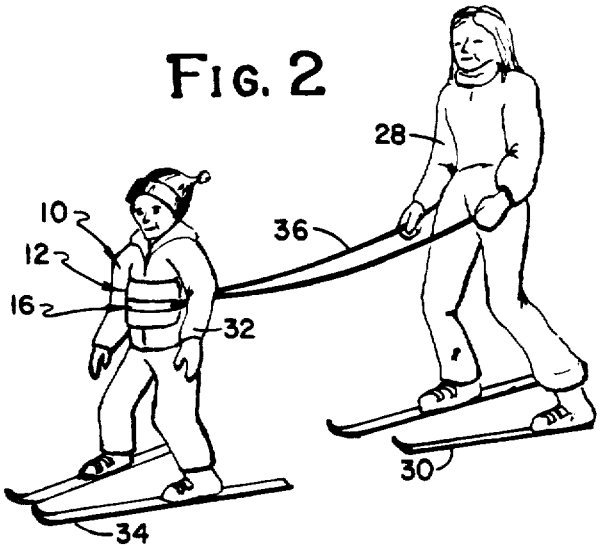
FIG. 3
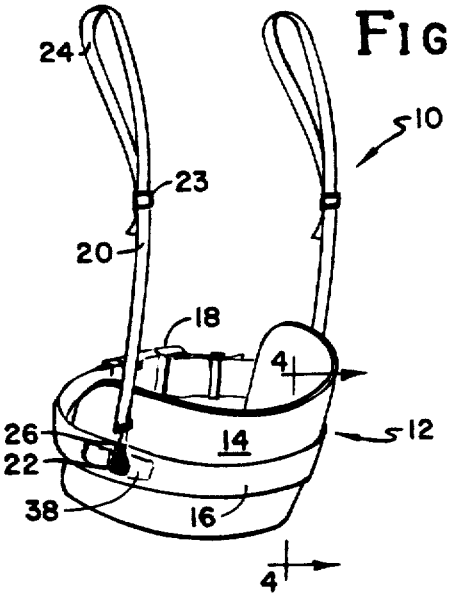
FIG. 4
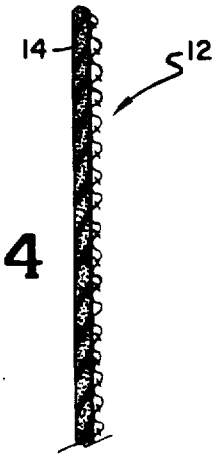
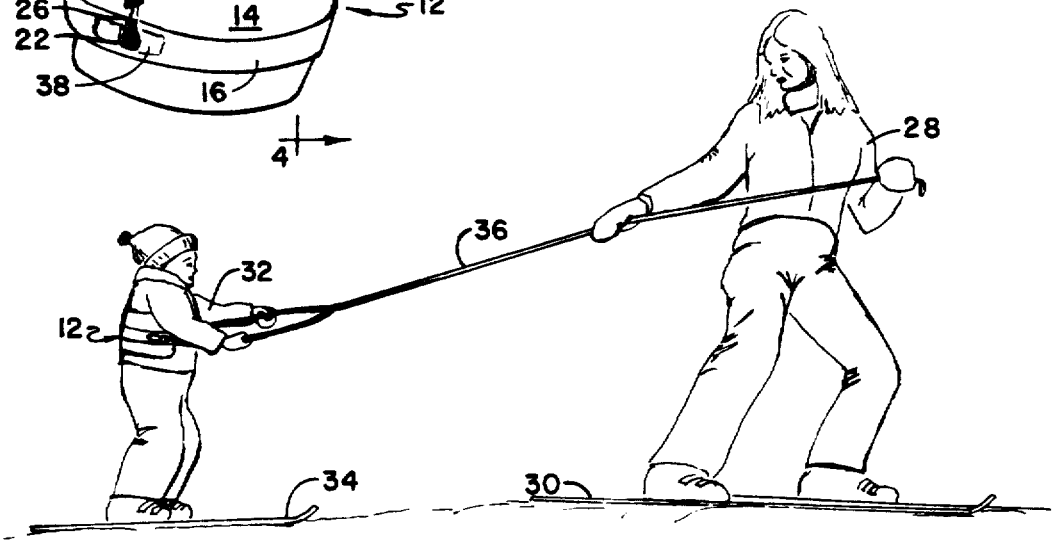
FIG. 5

METHOD FOR TEACHING CHILDREN TO SKI

This is a continuation of application Ser. No. 07/591,247, filed Sept. 27, 1990, now abandoned, which is a continuation of Ser. No. 07/435,755, filed Nov. 14, 1989, now abandoned.

This invention relates to a method and apparatus for teaching children to ski.

Teaching children, especially small children, to ski is an interesting experience for several reasons. Although they are easy to teach and eager to learn, to merely tell them what to do and expect them to do it is unrealistic. Thus, one shows the child what to do and tries to get the child to mimic the actions of the instructor. Taking this one step further, an instructor may grasp and turn the body of the child to show what needs to be done. If the child and the instructor are standing still, these efforts are not realistic and leave something to be desired. If the instructor is running or trying to ski next to the child, these efforts are confused and, in the excitement of falling down, the child often does not grasp the point. It will accordingly be seen that, at best, teaching a small child to ski is an awkward experience.

In response to the obvious difficulties, mechanical training aids have been proposed in the prior art. Training harnesses and like are shown in U.S. Pat. Nos. 3,014,284; 4,424,040; 4,505,681 and 4,509,921. This invention most nearly relates to these type devices. Other disclosures of interest are found in U.S. Pat. Nos. 3,487,474; 4,445,866; 4,666,017 and 4,756,555.

An observation providing a premise for an important part of this invention is that the desired control over the child changes as the child progresses. At an early stage, the instructor needs to exercise maximum control over the child by directly controlling speed, direction and weight distribution. At early stages, the instructor effectively takes the child by the hand. As the child becomes more comfortable and can ski a little, the instructor exercises less control over the child. At this stage, the instructor directly controls speed but indirectly controls direction and weight distribution thereby allowing the child to ski slowly with the instructor exercising some control.

In summary, one aspect of this invention comprises a training device for teaching children to ski including a wide member having opposite ends providing a torso encircling band and a connector for securing the ends together, a pair of first reins of a first length attached to the band on opposite sides thereof for extending under each arm of a child, and a pair of second reins of a second length for attachment to the band on opposite sides thereof for extending under each arm of a child.

Another aspect of this invention comprises a method of teaching a child on a first set of skis to ski by an instructor on a second set of skis including placing a harness on the child, attaching to the harness a first pair of reins of a first length, steps causing the instructor and child to ski together including positioning the instructor behind the child while straddling the first skis with the second skis and controlling speed and direction of the child with the first reins, attaching to the harness a second pair of reins of a second length longer than the first length, and steps causing the instructor and child to ski together including positioning the instructor behind the child a sufficient distance that the first and second skis cannot touch each other and controlling speed and direction of the child with the second reins.

An object of this invention is to provide an improved method and apparatus for teaching children to ski.

A further object of this invention is to provide a method and apparatus for teaching children to ski incorporating a harness and two sets of reins of different length.

Other objects and advantages of this invention will become more fully apparent as this description proceeds, reference being made to the accompanying drawings and appended claims.

IN THE DRAWINGS

FIG. 1 is a pictorial view of an instructor skiing with a child at an early stage of learning;

FIG. 2 is a pictorial view of the instructor skiing with the child at a later stage of learning using longer reins;

FIG. 3 is a plan view of the harness shown in FIGS. 1 and 2 with the short reins of FIG. 1;

FIG. 4 is an enlarged cross-sectional view of the harness of FIG. 3, taken substantially along line 4—4 thereof as viewed in the direction indicated by the arrows; and FIG. 5 is a pictorial view of the instructor pulling the child.

Referring to FIGS. 1-3, there is illustrated a ski instruction harness 10 of this invention comprising a body band 12 which extends around the torso of a child in the process of learning to ski. The body band 12 includes a wide padded member 14 having a strap 16 of webbing bonded or sewn thereto having ends extending beyond the member 14. The member 14 is preferably made of a foam rubber sheet material having a fabric backing as shown in FIG. 4. A buckle 18 at one end of the strap 16, on the back of the band 12, attaches the band 12 to the child. A pair of short starter reins 20 attach to D-rings 22 located generally under the arms of the child. The reins 20 include buckles 23 providing adjustable loops 24 at the free end thereof and clips 26 for attaching to the rings 22.

At an early stage of instruction, as shown in FIG. 1, an instructor 28 on a pair of skis 30 stands immediately behind the child 32 on skis 34. The instructor 28 places the skis 30 in a snow plow position, i.e. in a V pointed downhill, and straddles the child 32 so the child's skis 34 are also in a slow plow position. The instructor 28 uses the short reins 20 to directly control the speed of the child 32 as the pair ski slowly. The instructor 28 also uses the knees and thighs to push against the child's back if necessary. Thus, in an early stage, the instructor 28 uses the short reins 20 and body contact to directly control the direction of the child 32 because the child 32 cannot ski in a different direction than the instructor 28.

The length of the short reins 20 is subject to some variation. The short reins 20 should be long enough that the instructor can stand up behind the child but short enough that the skis 30, 34 nest together as shown in FIG. 1. Preferably, the short reins 20 are about the length of an adult arm with the loops 24 providing adjustment to about ¾-1¼ adult arm length.

After the child 32 becomes more accustomed to skis, the starter reins 20 are replaced by longer teaching reins 36, also attached to the D-rings 22. The starter reins 20 may be removed or simply tucked into the top of the band 12 between the band 12 and the child. The longer reins 36 allow the instructor to ski behind the child as shown in FIG. 2 at a distance so the skis 30, 34 do not touch. The longer reins 36 are at least six feet long and preferably are about eight feet long having adjustable loops at the ends thereof. At this stage of learning, the instructor 28 directly controls the speed of the child 32 by pulling equally on the reins 36 but indirectly controls the direction of the child by differentially pulling on the long reins 36, it being clear that the child 32 can ski off in a slightly different direction than the instructor 28.

There are times when the instructor 28 needs to pull the child 32 as when crossing a flat area heading to the ski lift. For short distances, this is most easily accomplished by merely extending the long reins 36 forwardly of the child 32 and pulling the child. This places a substantial strain on the D-rings 22 and their attachment strips 38 which are simply sewn to the band 16 and member 14. For longer pulling distances, as when cross-country skiing, it is preferred to remove the band 12 and turn it backwards as shown in FIG. 5, i.e. the buckle 18 to the front of the child 32. This places the attachment strips 38 to minimize stress. In this situation, a bridle is preferably attached to the D-rings 22 and only one long rein 36 used.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A method of teaching a child on a first set of skis to ski by an instructor on a second set of skis comprising placing a harness on the child;

attaching to the harness a first pair of reins of a first length;

steps causing the instructor and child to ski together including positioning the instructor behind the child while straddling the first skis with the second skis and controlling speed and direction of the child with the first reins;

attaching to the harness a second pair of reins of a second length longer than the first length; and steps causing the instructor and child to ski together including positioning the instructor behind the child a sufficient distance that the first and second skis cannot touch each other and controlling speed and direction of the child with the second reins.

2. The method of claim 1 further comprising removing the first pair of reins before the last mentioned skiing step.

3. The method of claim 2 wherein the first mentioned skiing step comprises skiing with the second set of skis in a V-configuration pointed downhill and causing the child's skis to assume a V-configuration pointed downhill inside the second skis.

4. The method of claim 3 wherein the first mentioned skiing step comprises contacting the body of the child with the body of the instructor.

5. The method of claim 4 wherein the harness comprises a wide torso encircling band, the steps of attaching reins comprises attaching two reins to the band and extending one rein under each arm of the child and wherein the step of controlling the direction of the child comprises differentially pulling on the reins.

6. The method of claim 5 wherein the step of controlling the speed of the child comprises pulling equally on the reins.

* * * * *